US006949881B2

(12) United States Patent
Inaoka et al.

(10) Patent No.: US 6,949,881 B2
(45) Date of Patent: Sep. 27, 2005

(54) DISCHARGE LAMP OF THE SHORT ARC TYPE

(75) Inventors: Norihiro Inaoka, Hyogo-ken (JP); Takafumi Kimura, Kumamoto-ken (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 301 days.

(21) Appl. No.: 10/460,398

(22) Filed: Jun. 13, 2003

(65) Prior Publication Data

US 2003/0234615 A1 Dec. 25, 2003

(30) Foreign Application Priority Data

Jun. 19, 2002 (JP) ..... 2002-178778

(51) Int. Cl.[7] ..... H01J 61/35
(52) U.S. Cl. ..... 313/635; 313/112
(58) Field of Search ..... 313/623–625, 313/634–635, 112, 116

(56) References Cited

U.S. PATENT DOCUMENTS 6,356,018 B1 3/2002 Higashimoto et al.
2001/0010447 A1 8/2001 Yamane et al.
2002/0185972 A1 12/2002 Matsushima et al.
2003/0001503 A1 1/2003 Higashimoto et al.

*Primary Examiner*—Joseph Williams
(74) *Attorney, Agent, or Firm*—Nixon Peabody, LLP; David S. Safran

(57) ABSTRACT

A discharge lamp of the short arc type in which a lead pin, located within a hermetically sealed tube, is prevented from being irradiated with light. Such a construction prevents the lead pin from undergoing a temperature rise thereby preventing the destruction of the hermetically sealed tube. The discharge lamp of the short arc type includes an arc tube adjoined laterally by hermetically sealed tubes through which a lead pin, which supports an electrode, is routed. The hermetically sealed tubes are sealed by graded glass on the lead pins, and the lead pin is prevented from being irradiated with light by providing the outside surface of the hermetically sealed tube, at least in part, with a high emissivity material and then providing a reflectivity material on the exterior surface of the emissivity material.

12 Claims, 6 Drawing Sheets

DISCHARGE LAMP OF THE SHORT ARC TYPE

BACKGROUND OF THE INVENTION

1. Field of the Invention

The invention relates to a discharge lamp of the short arc type which is used as the light source of a projection device.

2. Description of the Related Art

Conventionally, the discharge lamp of the short arc type shown in FIG. 4 is known as the light source of a projection device such as a projector or the like. In this discharge lamp, bordering the two ends of the arc tube 1 of silica glass, are two hermetically sealed tubes 2 of silica glass. In the arc tube 1, there is a pair of tungsten electrodes 3 and lead pins 4 of tungsten, each supporting an electrode 3 and sealed by a graded glass 5. "Graded glass" is defined as glass with a changing coefficient of thermal expansion. If necessary, there can be a base 6 on the end of the hermetically sealed tube 2.

In such a discharge lamp of the short arc type, the internal pressure of the arc tube 1 is very high during operation in order to increase the radiance. Therefore, it is necessary to design the lamp such that the hermetically sealed tubes 2 are not damaged even at a high internal pressure. Furthermore, since a high current flows in the lamp, it is necessary for the respective lead pin 4 which supports the electrode 3 to project directly to the outside from the hermetically sealed tube 2 which adjoins the arc tube 1. For hermetic sealing of the hermetically sealed tube 2 on the lead pin 4, there is a hermetically sealed arrangement in which graded glass 5 is used.

FIG. 5 is a schematic cross section which shows the relation between the discharge lamp of the short arc type, a reflector and a light exit window when such a discharge lamp of the short arc type is installed in a projection device. In the projection device, there is a reflector 71 with a rotationally elliptical reflection surface and a reflector 72 with a rotationally spherical reflection surface arranged such that they surround the arc tube 1. The lamp is arranged such that the arc which forms between the electrodes 3 is located at the focal point of the reflector 71. The light which forms in the arc is focused by means of the reflector 71 and is reflected in the direction to the light exit window 8. The light deviating from the reflector 71 is captured by the reflector 72 and reflected back in the direction to the reflector 71 so that the light is efficiently used. The focused light which has been reflected by the reflectors 71, 72 passes through the light exit window 8 and irradiates a film, liquid crystal and the like.

However, as is shown in FIG. 5, the arc which forms between the electrodes 3 has a certain broadening. Part of the light which has formed in the arc and which is at a location which deviates from the focal point of the reflector 71 is reflected by means of the reflector 71 and is returned to the electrode 3. The light which has been reflected by the electrode 3 is radiated again onto the reflector 71. The light which has been reflected by means of the reflector 71 is emitted onto the hermetically sealed tube 2.

The light which has been emitted onto the hermetically sealed tube 2 passes through the hermetically sealed tube 2 and is emitted onto the lead pin 4 and the graded glass 5 since the hermetically sealed tube 2 is made of transparent glass. In particular, when the light is emitted onto the lead pin 4, the lead pin 4 is heated by the light, which causes its temperature to rise because the lead pin 4 is a component which does not transmit light.

Some of the light which has been formed in the arc at the location which deviates from the focal point of the reflector 71 is reflected by means of the reflector 71, is emitted directly onto the hermetically sealed tube 2 and heats the lead pin 4 (the light beam is, however, not shown in the drawings). Furthermore, part of the light which has been reflected by the surface of the light exit window 8 is emitted directly onto the hermetically sealed tube 2 and heats the lead pin 4 (not shown in the drawings either).

As shown in FIG. 6, the light which has penetrated into the arc tube 1 with a certain angular range is relayed within the arc tube 1 and within the hermetically sealed tube 2. In this way the relayed light L4 reaches the lead pin 4, or the light L3 which has emerged from the inside of the hermetically sealed tube 2 in the direction to the lead pin 4 is emitted onto the lead pin 4 and heats the latter. Furthermore, there is light L2 which emerges from the inside of the hermetically sealed tube 2 in the direction out of the lamp.

If the temperature of the lead pin 4 increases in this way by the irradiation of the lead pin 4 with light, the heat of the lead pin 4 is conducted to the graded glass 5 which is sealed on the lead pin 4. In this way, the disadvantage occurs that the temperature of the graded glass 5 rises, which results in stress in the graded glass 5 such that eventually cracks form and that the hermetically sealed arrangement is destroyed.

Furthermore, there is the following disadvantage that the end of the lead pin 4 projects to the outside from the end of the hermetically sealed tube 2. Since the projecting part is exposed to outside air, oxidation of the lead pin 4 continues when the lead pin 4 reaches a high temperature. As a result, expansion of the lead pin 4 occurs, and cracks form in the graded glass 5 in contact with the lead pin 4. The hermetically sealed arrangement is therefore destroyed.

SUMMARY OF THE INVENTION

The discharge lamp of the short arc type of the invention eliminates the above described disadvantages in the prior art. A primary object of the invention is to construct a discharge lamp of the short arc type in which the disadvantages mentioned above are suppressed such that when the lead pin, which is located within the hermetically sealed tube, is irradiated with light a rise in temperature of the lead pin is prevented, and thus, fracturing of the graded glass and destruction of the hermetically sealed arrangement is also prevented.

According to a first embodiment of the invention, in a discharge lamp of the short arc type having hermetically sealed tubes adjoining opposite ends of the arc tube and having lead pins supporting the electrodes sealed in the hermetically sealed tubes by graded glass, the object is achieved by providing the outside surface of the above described respective hermetically sealed tube with a heat absorption film and providing the surface of this heat absorption film with a light reflection film.

The object of the invention is achieved according to one manner in the short arc type described in the first embodiment where the above described heat absorption film is a high emissivity material which has an emissivity greater than or equal to 0.5 of the light in a wavelength range from 200 nm to 1500 nm and 2500 nm to 5000 nm.

The object of the invention is achieved according to another manner in the discharge lamp of the short arc type in that where the above described light reflection film is a reflectivity material which reflects light in the wavelength range from 200 nm to 1500 nm and transmits light in the wavelength range from 2500 nm to 5000 nm.

The invention is further described below via one embodiment illustrated in the drawings.

DETAILED DESCRIPTION OF THE INVENTION

Figure 1:
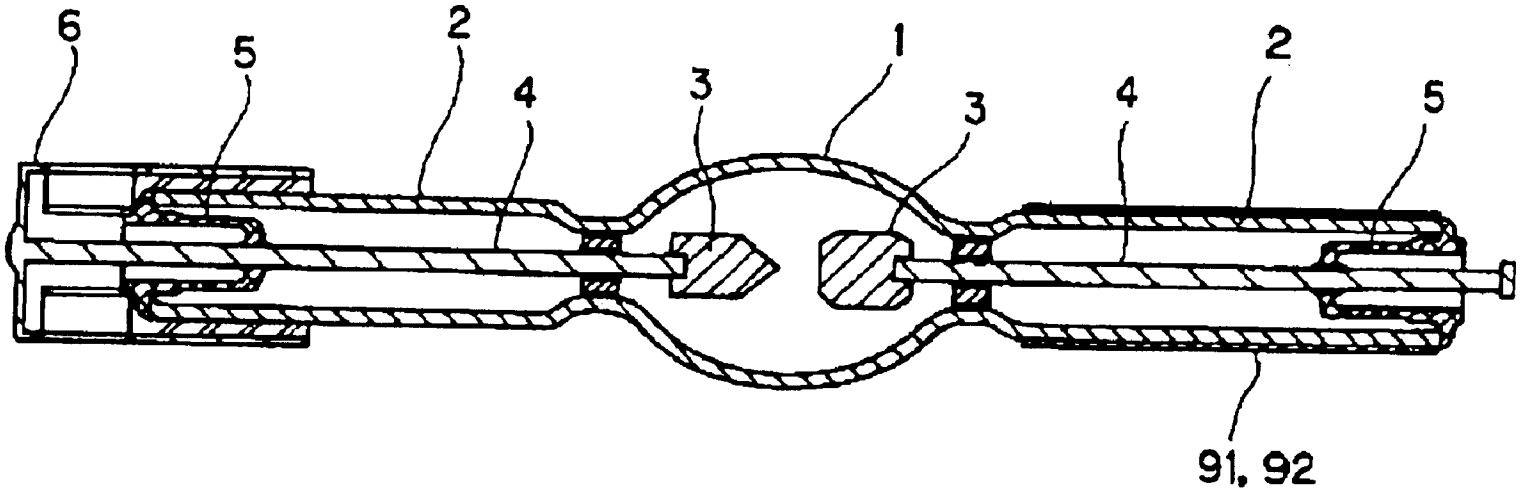
FIG. 1 shows a cross section of the arrangement of the discharge lamp of the short arc type of the invention.

FIG. 1 shows a cross section of the arrangement of a discharge lamp of the short arc type of the invention. In this discharge lamp, hermetically sealed tubes 2 of silica glass border the two ends of)the arc tube 1 of silica glass. In the arc tube 1, there is a pair of tungsten electrodes 3, each of which is supported by a lead pin 4 of tungsten sealed in the hermetically sealed tube 2 by a graded glass 5 which extends in the direction toward the inside of the hermetically sealed tube 2. If necessary, there is a base 6 on the end of the hermetically sealed tube 2.

Figure 5:
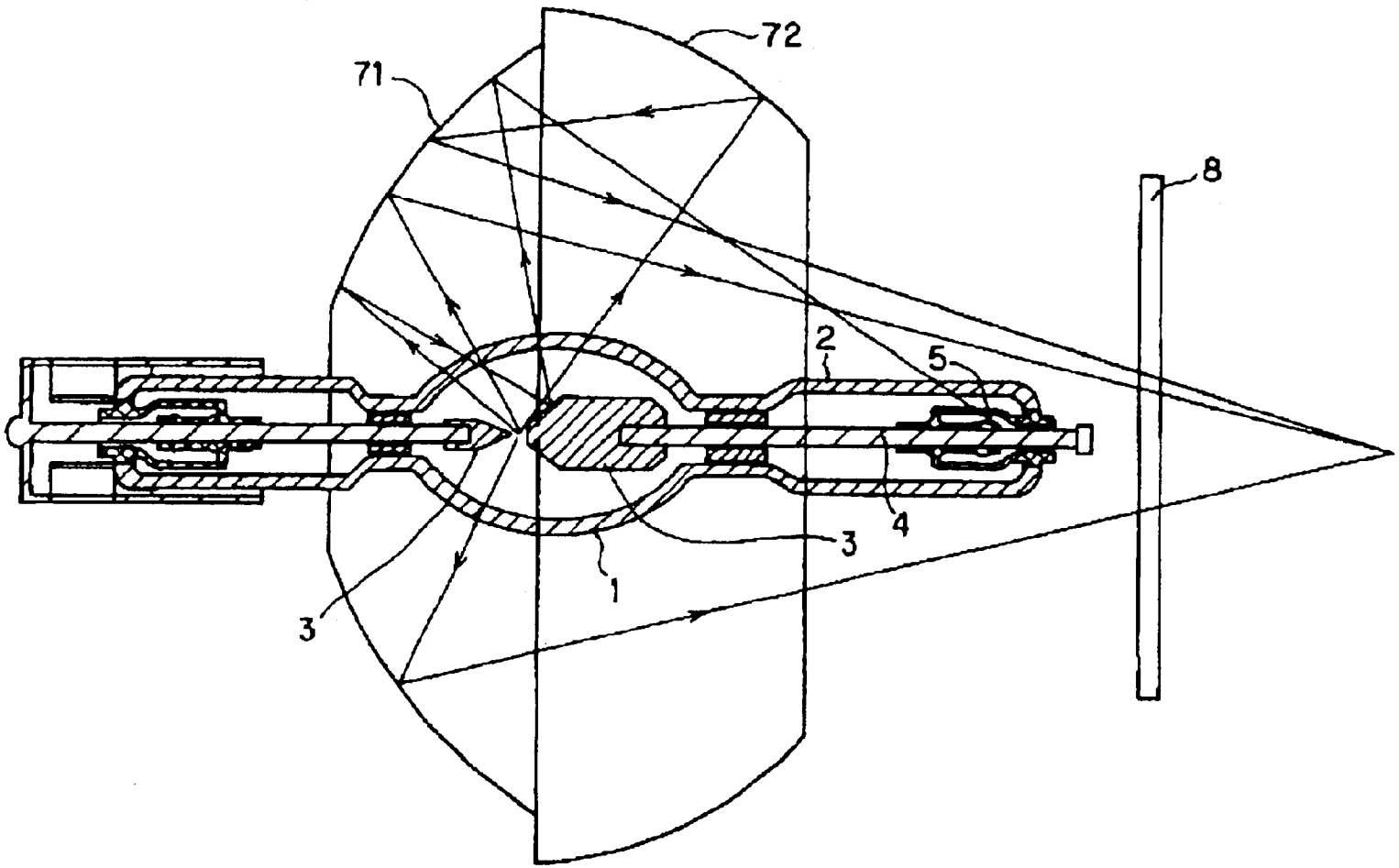
Fig. 5 (Prior Art)
FIG. 5 shows a schematic cross section of the relation between the discharge lamp of the short arc type, the reflector and the light exit window for installation of a discharge lamp of the short arc type in a projection device and, FIG. 6 shows a schematic of the light which is transmitted within an arc tube and within a hermetically sealed tube.

Upon installation of the discharge lamp of the short arc type of the invention into a projection device, as shown in FIG. 5, the outside surface of the hermetically sealed tube 2 is provided with a high emissivity material 91 on the right side in FIG. 1 which is, located in the direction in which the light has been reflected by the reflectors 71, 72. Furthermore, the surface of the high emissivity material 91 is provided with a reflectivity material 92.

In FIG. 1, only the hermetically sealed tube 2 on the right side is provided with a high emissivity material 91 and a reflectivity material 92, but when there are two hermetically sealed tubes 2, each can be provided with the high emissivity material 91 and the reflectivity material 92.

The arc tube 1 is filled with xenon as the emission gas of 8.5 MPa at 25° C. with respect to atmospheric pressure. Operation takes place with nominal values of 70 A and 28 V. During operation, the lamp light is produced principally in the visible range.

Figure 2:
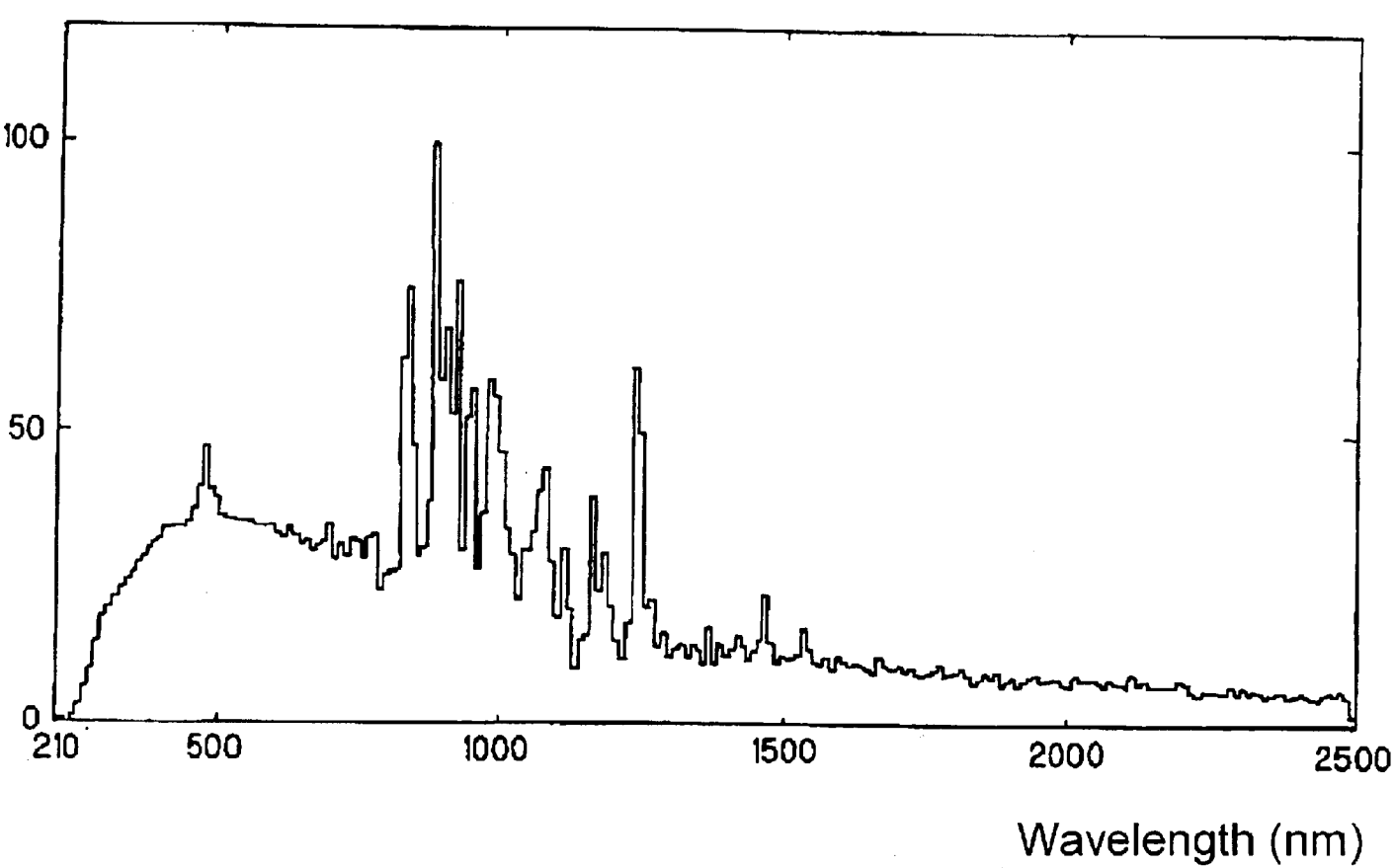
FIG. 2 illustrates the wavelength distribution of the light which is emitted by a discharge lamp of the short arc type of the invention.

As is shown in FIG. 2, light is continuously emitted in a wide wavelength range from UV radiation up to IR radiation by this discharge lamp of the short arc type.

Figure 3:
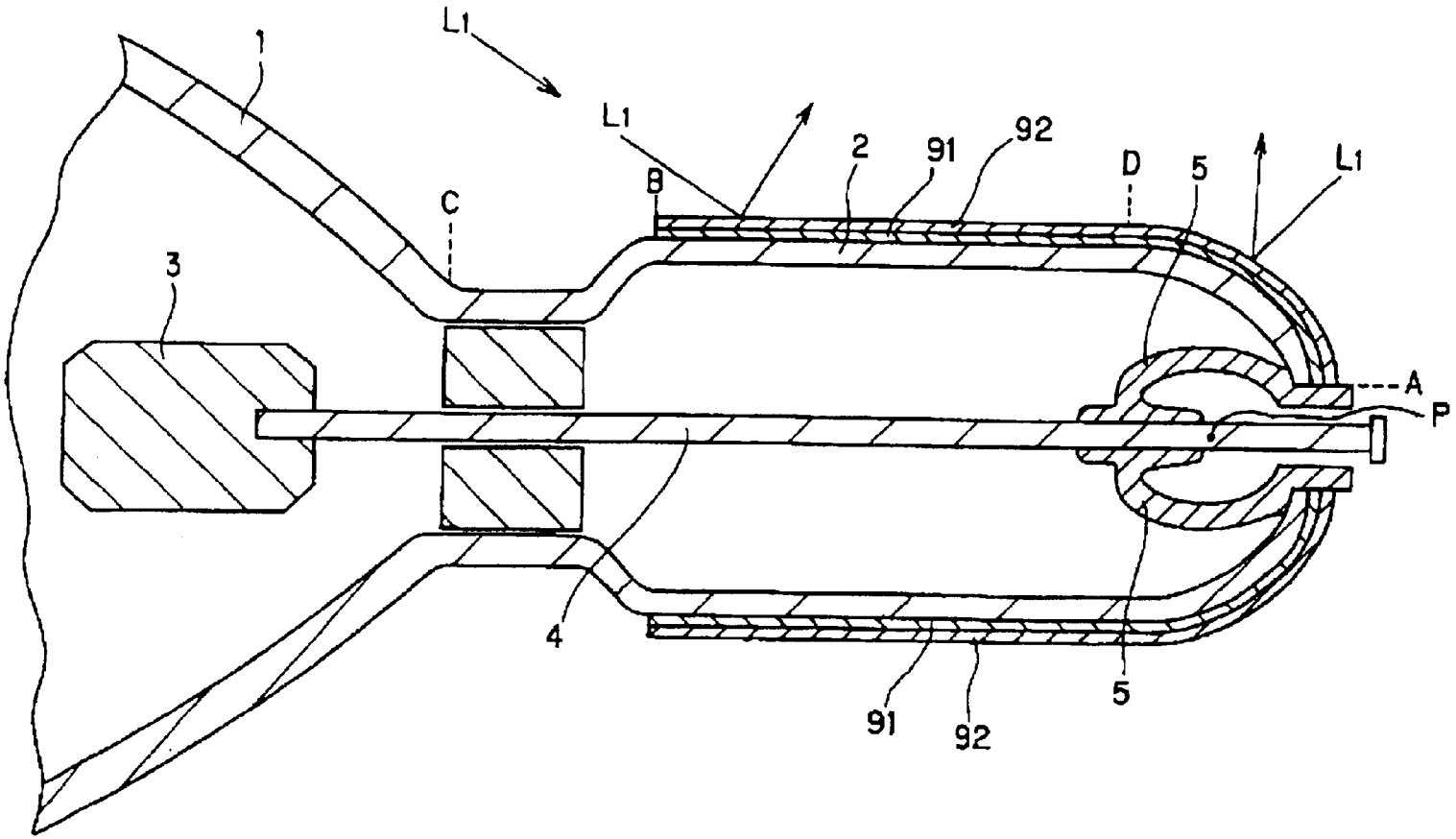
FIG. 3 shows, in an enlarged view, a cross section of the hermetically sealed tube of a discharge lamp of the short arc type of the invention.
Figure 4:
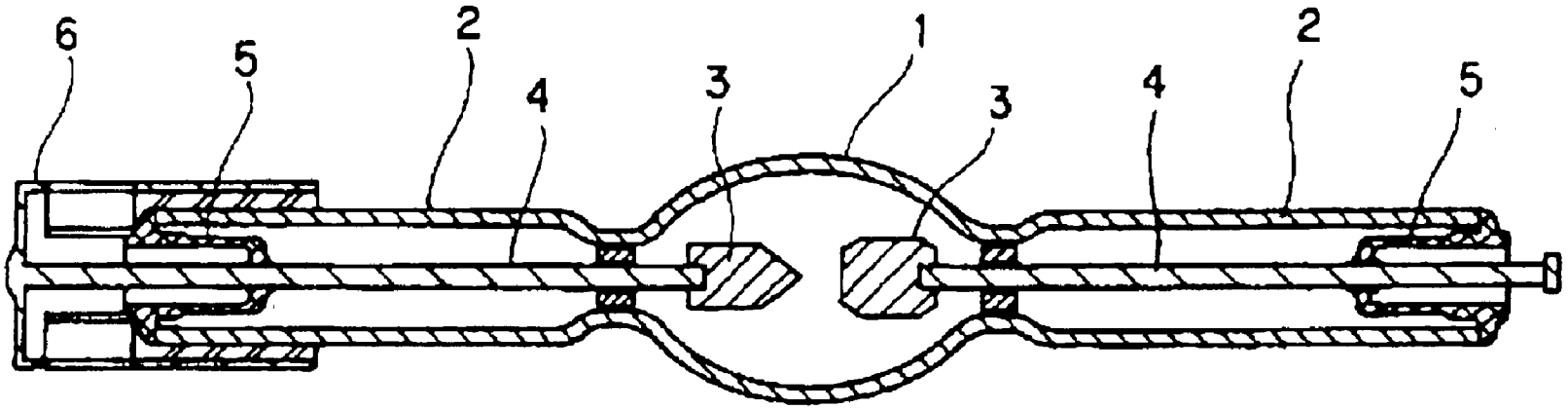
Fig. 4 (Prior Art)
FIG. 4 shows a cross section of the arrangement of a conventional discharge lamp of the short arc type.

FIG. 3 is a cross section in an enlarged partial view which illustrates the high emissivity material and the reflectivity material which are located on the hermetically sealed tube. As is shown in FIG. 3, the surface of the hermetically sealed tube 2 of silica glass is provided with a high emissivity material 91. The high emissivity material 91 can have an emissivity of light that is at least 0.5, preferably at least 0.9, of the wavelength range from 200 nm to 1500 nm and 2500 nm to 5000 nm. This high emissivity material 91 is a black film and is formed specifically by applying and drying a black, heat-resistant dye.

The surface of the high emissivity material 91 is then provided with the reflectivity material 92. The reflectivity material 92 reflects light in a wavelength range from 200 nm to 1500 nm and transmits light in a wavelength range from 2500 nm to 5000 nm. Such a reflectivity material 92 can be a film which contains light-reflecting, metallic particles. Specifically, the film is formed by mixing silver particles, as the light-reflecting metallic particles, into silicone resin, applying the film and drying the film.

The high emissivity material 91 can also be a vitreous coating in which metallic particles are dispersed, or a vitreous coating in which carbon particles are dispersed. The reflectivity material 92 can also be a dielectric, multi-layer film of $TiO_2$—$SiO_2$. FIG. 3 shows the light which is emitted from the discharge lamp of the short arc type of the invention as the arrow L1. This light is light which is reflected by the reflector and which is also reflected by other components of the projection device, e.g., from the light exit window, or the like. This light L1 moves from outside the hermetically sealed tube 2 in the direction toward the hermetically sealed tube 2 and has a wide wavelength range from UV radiation to IR radiation, as was described above for FIG. 2.

This light L1 is emitted from outside onto the hermetically sealed tube 2, but since a reflectivity material 92 on the hermetically sealed tube 2 reflects light in a wavelength range from 200 nm to 1500 nm emitted from the lamp, as is shown in FIG. 2, the light L1 is prevented from being emitted onto the lead pin 4 which is present in the hermetically sealed tube 2.

Figure 6:
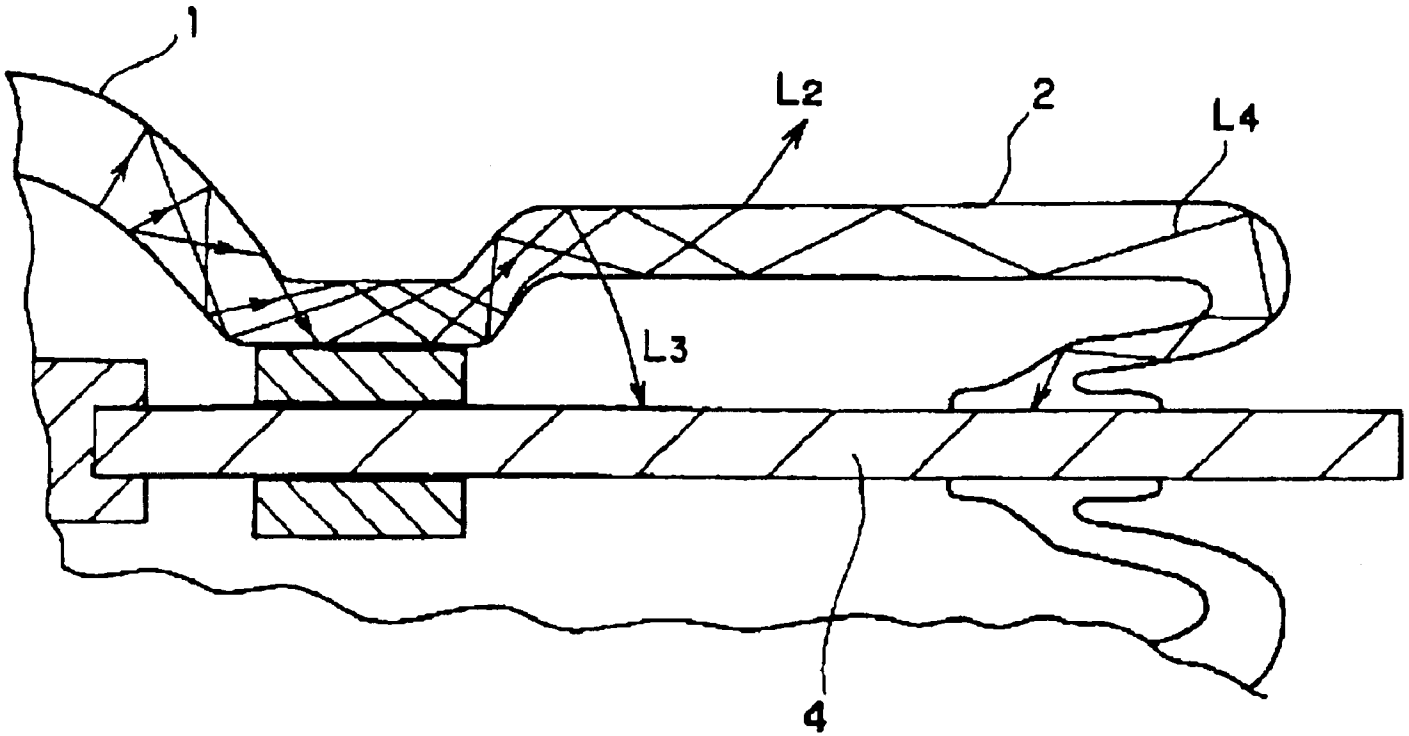
Fig. 6 (Prior Art)

Next, the high emissivity material 91 is described. If, during lamp operation, light is being transmitted in the arc tube 1 and in the hermetically sealed tube 2, as was described using FIG. 6, the light L2 which has emerged from the inside of the hermetically sealed tube 2 from the lamp is reflected by the reflectivity material 92, returns to the hermetically sealed tube 2 and is emitted onto the lead pin 4 when the surface of the hermetically sealed tube 2 is provided only with the reflectivity material 92. In this way, the temperature of the lead pin 4 in the opposing part is increased.

In order to prevent this from occurring, it is necessary to place a high emissivity material 91 between the surface of the hermetically sealed tube 2 and the reflectivity material 92. This high emissivity material 91 absorbs and emits light in a wavelength range from 200 nm to 1500 nm. The emissivity of the high emissivity material 91 is preferably at least 0.5, more preferably at least 0.9.

If, therefore, the reflectivity material 92 is arranged so that the light L1 is not emitted from outside the lamp onto the lead pin 4, the light L2 which emerges from the lamp from the inside of the hermetically sealed tube 2 is not emitted onto the lead pin 4 due to the absorption of this light L2 by the high emissivity material 91, then the amount of light emitted onto the lead pin 4 can be reduced and the temperature increase of the lead pin 4 can be suppressed.

The electrode 3, during lamp operation, reaches a very high temperature, i.e., its tip areas reaches roughly 2000° C. As a result, heat is also transferred to the inner lead pin 4 which supports the electrode 3 and transmitted to the lead pin 4 which is present in the hermetically sealed tube 2. Since the heat radiated here by the lead pin 4 is emitted as light in the wavelength range from 2500 nm to 5000 nm, the high emissivity material 91 absorbs the light in the wavelength range from 2500 nm to 5000 nm and emits it from the lamp.

On the other hand, the reflectivity material 92 transmits the light in the wavelength range from 2500 nm to 5000 nm which is emitted by the high emissivity material 91 and radiates it from the lamp. The reflectivity material 92 therefore transmits the light in the wavelength range from 2500 nm to 5000 nm.

Placing the high emissivity material 91 on the surface of the hermetically sealed tube 2 and the reflectivity material 92 on the surface of the high emissivity material 91 in this manner will prevent the lead pin 4, located in the hermetically sealed tube 2, from being irradiated with the light L1 from outside the hermetically sealed tube 2. The high emissivity material 91 can absorb the light L2 which emerges from the inside of the hermetically sealed tube 2 of the lamp, and can also absorb the heat which has been radiated from the lead pin 4 and radiate this heat via the reflectivity material 92. Therefore, a temperature increase of the lead pin 4 and thus a temperature increase of the graded glass 5 which is sealed on the lead pin 4 can be prevented. Therefore crack formation is prevented in the graded glass 5.

Since the temperature increase of the lead pin 4 can be prevented, the oxidation of the lead pin 4 can be suppressed in the area which projects to the outside from the end of the hermetically sealed tube 2. Thus, the formation of cracks in the graded glass 5 by oxidation of the lead pin 4 can also be prevented. With a discharge lamp of the short arc type of this embodiment of the invention, a discharge lamp of the short arc type is obtained in which the hermetically sealed arrangement is not destroyed.

Next, an experiment was run in which the temperature of the lead pin during operation was studied using the discharge lamp of the short arc type of the invention in which in the hermetically sealed tube is provided with the high emissivity material and the reflectivity material, and using a conventional discharge lamp of the short arc type with neither a material with high emissivity nor a reflectivity material.

The discharge lamp of the short arc type of the invention and the conventional discharge lamp of the short arc type have exactly the same lamp specifications except for the presence of the high emissivity material and the reflectivity material of the invention on the hermetically sealed tube. These lamps have a nominal value of 1.9 kW.

The high emissivity material is the above described film which was formed by applying and drying a black, heat-resistant dye. The reflectivity material is the above described film which has been formed by silver particles as light-reflecting metallic particles being mixed into silicone resin, applied and dried.

The area in which the surface of the hermetically sealed tube is provided with high emissivity material and reflectivity material is the area from the end A of the hermetically sealed tube 2 to the area B in which the hermetically sealed tube 2 begins to contract, as is illustrated in FIG. 3.

The temperature of the lead pin 10 minutes after reaching a stable state after the start of lamp operation was measured. The measurement point of the lead pin is shown as the area P in FIG. 3. This point is located on the side of the outer end of the lead pin 4 and is adjacent to the area in which the graded glass 5 and the lead pin 4 are sealed against one another. Table 1 shows the measurement results.

TABLE 1

| Temperature | High Emissivity Material | Reflectivity Material | Lead Pin |
|---|---|---|---|
| Conventional Lamp | absent | absent | 419° C. |
| Inventive Lamp | present | present | 332° C. |

As is apparent from the Table 1 above, in the lamp of the invention, the temperature of the lead pin compared to the conventional lamp has dropped by 87° C. As a result, in the lamp of the invention, the temperature increase of the graded glass is reliably suppressed and crack formation as a result of the temperature increase of the graded glass is prevented. This also prevents the hermetically sealed arrangement from being destroyed.

The surface area of the hermetically sealed tube provided with the high emissivity material and the reflectivity material, besides the above described area, can also be an area which extends proceeding from the end A of the hermetically sealed tube 2 via the area B in which the hermetically sealed tube 2 begins to contract to as far as the boundary area C between the hermetically sealed tube 2 and the arc tube 1, as is shown using FIG. 3, or surface area can also be only an area which corresponds to the linear area of the hermetically sealed tube 2 between D and B.

The most effective area in which the surface of the hermetically sealed tube is provided with a high emissivity material and a reflectivity material is, however, the entire surface area of the hermetically sealed tube 2 which extends proceeding from the end A of the hermetically sealed tube 2 via the area B in which the hermetically sealed tube 2 begins to contract as far as the boundary area C between the hermetically sealed tube 2 and the arc tube 1.

As was described above, in the discharge lamp of the short arc type in accordance with the invention there are the following effects. Placing a high emissivity material on the surface of the hermetically sealed tube and a reflectivity material on the surface of the high emissivity material can prevent the light from outside the hermetically sealed tube from irradiating the lead pin located within the hermetically sealed tube. The high emissivity material can absorb the light which emerges from the inside of the hermetically sealed tube from the lamp and can also absorb the heat which has been radiated from the lead pin and radiate this heat through the reflectivity material 92. Therefore, a temperature increase of the lead pin and thus a temperature increase of the graded glass which is sealed on the lead pin can be prevented. As a result, crack formation is prevented in the graded glass. Thus, a discharge lamp of the short arc type is obtained in which the hermetically sealed arrangement is not destroyed.

What is claimed is:

1. Discharge lamp of the short arc type comprising:

an arc tube having hermetically sealed tubes at each of opposite ends thereof, a lead pin supporting an electrode being routed through each of the hermetically sealed tubes, wherein the hermetically sealed tubes are sealed onto each of the lead pins by graded glass, wherein an exterior surface of at least one of the hermetically sealed tubes is provided at least in part with a high emissivity material, and wherein a reflectivity material is provided on an exterior surface of the high emissivity material.

2. Discharge lamp of the short arc type as claimed in claim 1, wherein the high emissivity material is also a heat-absorbing material.

3. Discharge lamp of the short arc type as claimed in claim 1, wherein the high emissivity material has an emissivity of at least 0.5 of the light in wavelength ranges from 200 nm to 1500 nm and 2500 nm to 5000 nm.

4. Discharge lamp of the short arc type as claimed in claim 1, wherein the reflectivity material reflects light in a wavelength range from 200 nm to 1500 nm and transmits light in a wavelength range from 2500 nm to 5000 nm.

5. Discharge lamp of the short arc type as claimed in claim 3, wherein the high emissivity material is a layer of black, heat-resistant dye.

6. Discharge lamp of the short arc type as claimed in claim 3, wherein the high emissivity material is formed by a layer which contains particles which are selected from the group consisting of metallic particles and carbon particles.

7. Discharge lamp of the short arc type as claimed in claim 6, wherein the particles are embedded in a vitreous material.

8. Discharge lamp of the short arc type as claimed in claim 4, wherein the reflectivity material is a layer which contains light-reflecting particles.

9. Discharge lamp of the short arc type as claimed in claim 8, wherein the light-reflecting particles are metallic particles.

10. Discharge lamp of the short arc type as claimed in claim 9, wherein the light-reflecting particles are embedded in silicone resin.

11. Discharge lamp of the short arc type as claimed in claim 4, wherein the reflectivity material is a dielectric, multi-layer film of $TiO_2$—$SiO_2$.

12. Discharge lamp of the short arc type as claimed in claim 9, wherein the light-reflecting particles are silver particles.

* * * * *